US007362295B2

(12) United States Patent
Park et al.

(10) Patent No.: US 7,362,295 B2
(45) Date of Patent: Apr. 22, 2008

(54) APPARATUS AND METHOD FOR DRIVING LIQUID CRYSTAL DISPLAY AND FOR DETERMINING TYPE OF IMAGE REPRESENTED BY IMAGE DATA

(75) Inventors: Dong-Won Park, Seoul (KR); Sang-Soo Kim, Seoul (KR)

(73) Assignee: Samsung Electronics Co. Ltd., Gyeonggi-Do (KR)

( * ) Notice: Subject to any disclaimer, the term of this patent is extended or adjusted under 35 U.S.C. 154(b) by 604 days.

(21) Appl. No.: 10/799,021

(22) Filed: Mar. 11, 2004

(65) Prior Publication Data

US 2004/0179002 A1 Sep. 16, 2004

(51) Int. Cl.
*G09G 3/36* (2006.01)

(52) U.S. Cl. ..... 345/89

(58) Field of Classification Search ..... 345/89, 345/204, 211–214, 690
See application file for complete search history.

(56) References Cited

U.S. PATENT DOCUMENTS

| | | | | |
|---|---|---|---|---|
| 5,844,534 | A | 12/1998 | Okumura et al. | |
| 6,211,854 | B1 * | 4/2001 | Fujiyoshi | 345/10 |
| 6,366,317 | B1 * | 4/2002 | Mattison et al. | 348/241 |
| 6,693,676 | B2 * | 2/2004 | Yamaguchi et al. | 348/452 |
| 6,828,986 | B2 * | 12/2004 | Sakashita et al. | 345/629 |
| 6,972,740 | B2 * | 12/2005 | Lee et al. | 345/60 |
| 7,081,906 | B2 * | 7/2006 | Kim et al. | 345/690 |
| 2001/0043181 | A1 * | 11/2001 | Park | 345/87 |
| 2002/0130830 | A1 * | 9/2002 | Park | 345/99 |
| 2003/0080932 | A1 * | 5/2003 | Konno et al. | 345/96 |

FOREIGN PATENT DOCUMENTS

| | | |
|---|---|---|
| JP | 07-244571 | 9/1995 |
| JP | 10-074064 | 3/1998 |
| JP | 10-097227 | 4/1998 |
| JP | 2000-172719 | 6/2000 |
| JP | 2001-025022 | 1/2001 |
| JP | 2002-123223 | 4/2002 |
| JP | 2002-199351 | 7/2002 |
| JP | 2002-323881 | 11/2002 |
| KR | 100271132 B1 | 8/2000 |
| KR | 1020010035842 | 5/2001 |
| KR | 1020020022008 | 3/2002 |
| KR | 1020020068951 | 8/2002 |

* cited by examiner

*Primary Examiner*—Amr A. Awad
*Assistant Examiner*—Rodney Amadiz
(74) *Attorney, Agent, or Firm*—MacPherson Kwok Chen & Heid LLP

(57) ABSTRACT

An apparatus of driving a liquid crystal display includes a signal controller. The signal controller has a frame memory and an image type detector. The signal controller compares image data for a present frame from an external device with image data for a previous frame stored in the frame memory and determines whether the image data represent still image. If the image data represent a sill image, the signal controller suspends a predetermined control operation and also suspends supply voltages to elements required for the predetermined control operation.

35 Claims, 4 Drawing Sheets

APPARATUS AND METHOD FOR DRIVING LIQUID CRYSTAL DISPLAY AND FOR DETERMINING TYPE OF IMAGE REPRESENTED BY IMAGE DATA

CROSS-REFERENCE TO RELATED APPLICATION

This application claims priority, under 35 U.S.C. Section 119, from Korean Patent Application Serial Number 2003-0015127 filed on Mar. 11, 2003, which is incorporated herein by reference in its entirety.

BACKGROUND OF THE INVENTION (a) Field of the Invention

The present invention relates to an apparatus and a method of driving a liquid crystal display.

(b) Description of Related Art

Liquid crystal displays (LCDs) include two panes having pixel electrodes and a common electrode and a liquid crystal (LC) layer with dielectric anisotropy, which is interposed between the two panels. The pixel electrodes are arranged in a matrix, connected to switching elements such as thin film transistors (TFTs), and supplied with data voltages through the switching elements. The common electrode covers entire surface of one of the two panels and is supplied with a common voltage. The pixel electrode, the common electrode, and the LC layer form a LC capacitor in circuital view, which is a basic element of a pixel along with the switching element connected thereto.

In the LCD, the two electrodes supplied with the voltages generate electric field in the LC layer, and the transmittance of light passing through the LC layer is adjusted by controlling the strength of the electric field, thereby obtaining desired images. In order to prevent image deterioration due to the unidirectional electric field, polarity of the data voltages with respect to the common voltage is reversed every frame, every row, or every dot.

However, since the response time of LC molecules is slow, it takes time for a voltage charged in the LC capacitor (referred to as a "pixel voltage" hereinafter) to reach a target voltage, which gives a desired luminance, thereby deteriorating the image quality of the LCD. In order to improve the image deterioration due to the response delay, several techniques such as DCC (dynamic capacitance compensation), ACCE (adaptive color contrast enhancement), and ACC (accurate color capture) are suggested to be applied.

However, these techniques require large power consumption.

SUMMARY OF THE INVENTION

An apparatus for driving a liquid crystal display including a plurality of pixels arranged in a matrix is provided, which includes: a gray voltage generator generating a plurality of gray voltages; a data driver selecting data voltages from the gray voltages corresponding to image data and applying the data voltages to the pixels; and a signal controller supplying the image data for the data driver, determining whether image represented by the image data is motion image or still image based on the difference in the image data between frames, and suspending predetermined control operation if the image is determined to be a still image.

The predetermined control operation may include at least one of image data modifications that include DCC (dynamic capacitance compensation), ACCE (adaptive color contrast enhancement), and ACC (accurate color capture).

Preferably, the signal controller determines the image as a motion image when the number of the pixels having different image data between two adjacent frames or the number of the pixels having the difference in the image data between two adjacent frames larger than a predetermined value is more than a predetermined number.

The signal controller may include: a data comparator comparing a present image data with a previous image data for each pixel and generating a first comparison signal for each pixel row, the first comparison signal having pulses generated when the present image data differs from the previous image data or when the difference between the present image data and the previous image data is larger than a predetermined value; a first counter counting the number of the pulses contained in each of the first comparison signals and generating a second comparison signal for each frame, the second comparison signal having pulses generated when the number of the counted pulses in the respective first comparison signals is larger than a first predetermined number; a second counter counting the number of the pulses contained in each of the second comparison signals and generating a third comparison signal for each of first periods, the third comparison signal having pulses generated when the number of the counted pulses in the respective second comparison signals is larger than a second predetermined number; and a frame state detector determining that image data for respective second periods following the first periods represent motion images if the respective number of the pulses contained in the third comparison signals for the first periods is more than a third predetermined number and, that if not, the image data for the second periods represent as still images, and outputting an image type selection signal having a first state or a second state based on the determination.

The first predetermined number may be larger than 30% of the total number of possible pulses in the first comparison signal, the second predetermined number may be larger than 30% of the total number of possible pulses in the second comparison signal, and the third predetermined number may be equal to or larger than one.

The image type selection signal may maintain either the first state or the second state during a second period and a following first period, and the first state is one of a high state or a low state.

The signal controller may further include a frame memory storing image data for at least one frame.

A method for driving a liquid crystal display including a plurality of pixels arranged in a matrix is provided, which includes: reading out image data of a previous frame and of a present frame; comparing the image data of the previous frame with the image data of the present frame for every pixel; generating a first comparison signal for each pixel row, the first comparison signal including pulses generated when the image data of the previous frame differs from the image data of the present frame or the difference between the image data of the previous frame and the image data of the present frame is larger than a predetermined value; counting the number of the pulses included in each of the first comparison signals; generating a second comparison signal for each frame, the second comparison signal including pulses generated when the number of the counted pulses in the respective first comparison signals is larger than the first predetermined number; counting the number of the pulses included in each of the second comparison signals; generating a third comparison signal for each of first periods, the third comparison signal including pulses generated when the number of the counted pulses in the respective second comparison signals is larger than a second predetermined number; determining that image data for respective second periods following the first periods represent motion image when the respective number of the pulses included in the third comparison signals is larger than a third determined number, determining as still image if not; and suspending predetermined control operation if the image data represent still image.

A first period may include five sequential frames, and a second period may include twenty five sequential frames.

A type of an image for a first period may be determined to be the same as the type of the image for a preceding second period.

BRIEF DESCRIPTION OF THE DRAWINGS

The present invention will become more apparent by describing embodiments thereof in detail with reference to the accompanying drawing in which.

DETAILED DESCRIPTION OF EMBODIMENTS

Figure 1:
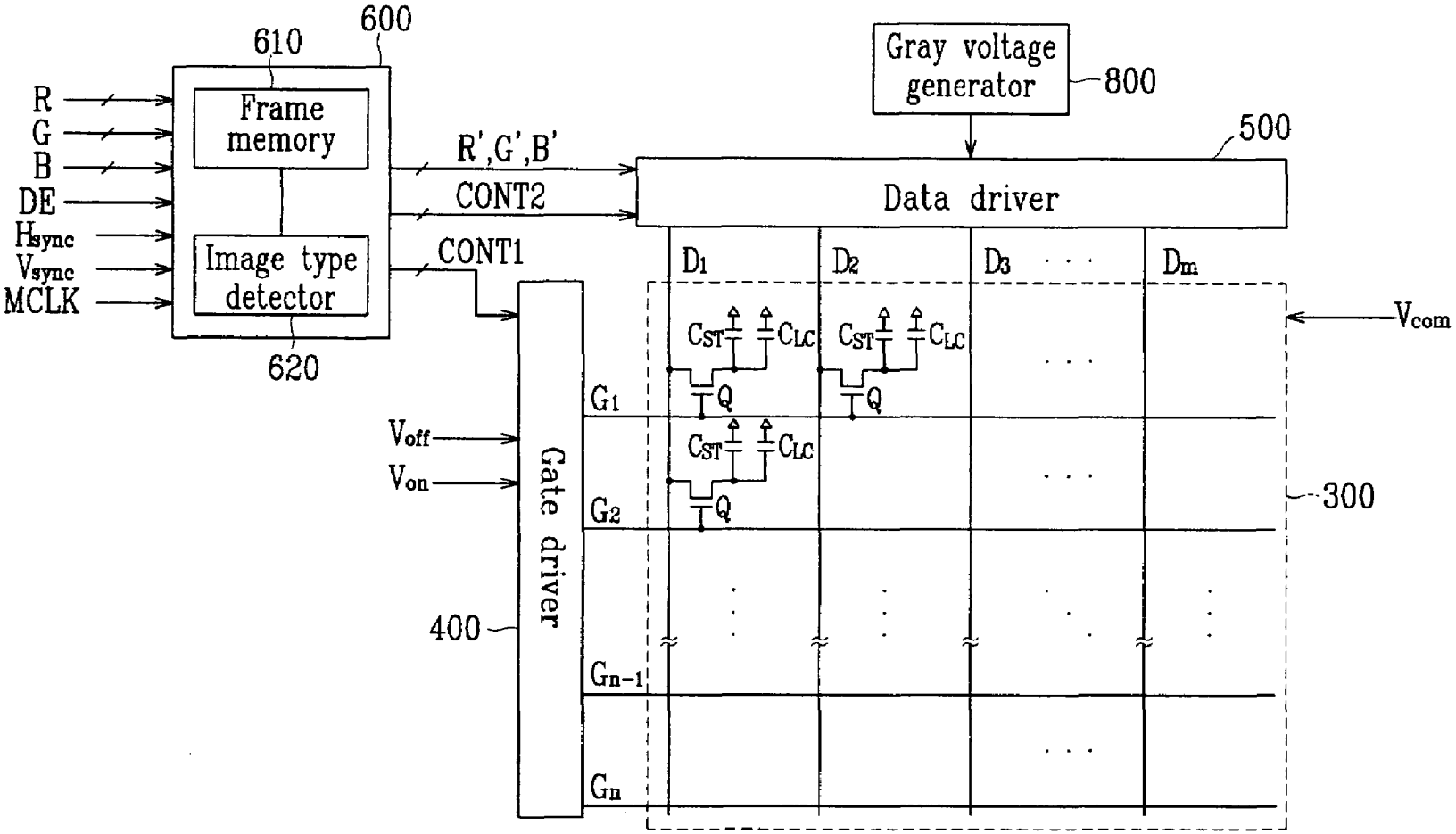
FIG. 1 is a block diagram of an LCD according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, apparatus and methods of driving a liquid crystal display according to embodiments of the present invention will be described with reference to the accompanying drawings.

Figure 2:
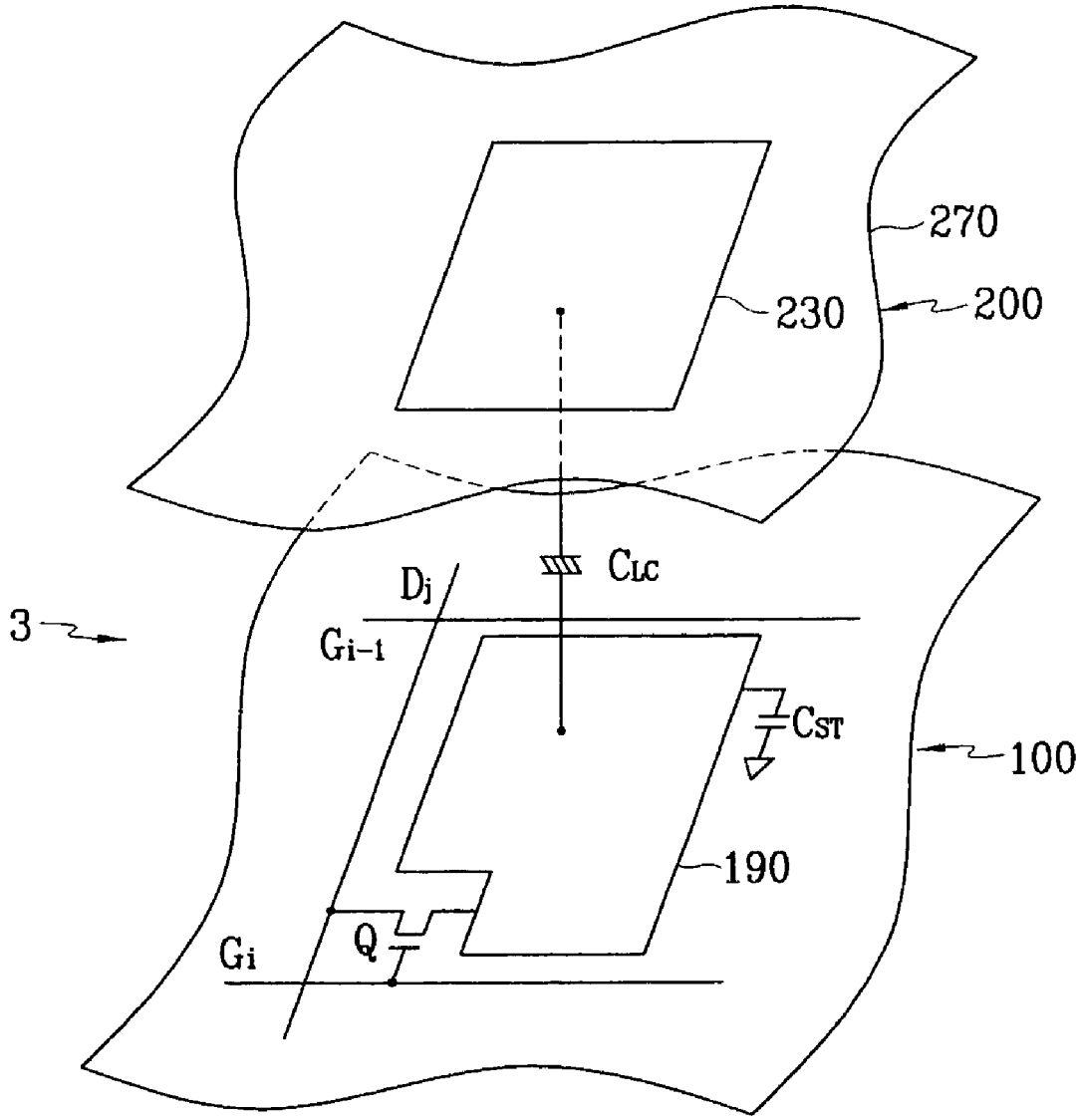
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment includes a LC panel assembly 300, a gate driver 400 and a data driver 500 that are connected to the panel assembly 300, a gray voltage generator connected to the data driver 500, and a signal controller 600 controlling the above elements.

In circuital view, the panel assembly 300 includes a plurality of display signal lines $G_1$-$G_n$ and $D_1$-$D_m$ and a plurality of pixels connected thereto and arranged substantially in a matrix.

The display signal lines $G_1$-$G_n$ and $D_1$-$D_m$ include a plurality of gate lines $G_1$-$G_n$ transmitting gate signals (also referred to as "scanning signals"), and a plurality of data lines $D_1$-$D_m$ transmitting data signals. The gate lines $G_1$-$G_n$ extend substantially in a row direction and substantially parallel to each other, while the data lines $D_1$-$D_m$ extend substantially in a column direction and substantially parallel to each other.

Each pixel includes a switching element Q connected to the signal lines $G_1$-$G_n$ and $D_1$-$D_m$, and a LC capacitor $C_{LC}$ and a storage capacitor $C_{ST}$ that are connected to the switching element Q. If necessary, the storage capacitor $C_{ST}$ may be omitted.

The switching element Q is provided on a lower panel 100 and has three terminals, a control terminal connected to one of the gate lines $G_1$-$G_n$, an input terminal connected to one of the data lines $D_1$-$D_m$ and an output terminal connected to both the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as dielectric of the LC capacitor $C_{LC}$. The pixel electrode 190 is connected to the switching element Q, and the common electrode 270 is connected to the common voltage $V_{com}$ and covers entire surface of the upper panel 200. Unlike FIG. 2, the common electrode 270 may be provided on the lower panel 100, and both electrodes 190 and 270 may have shapes of bars or stripes.

The storage capacitor $C_{ST}$ is an auxiliary capacitor for the LC capacitor $C_{LC}$. The storage capacitor $C_{ST}$ includes the pixel electrode 190 and a separate signal line (not shown), which is provided on the lower panel 100, overlaps the pixel electrode 190 via an insulator, and is supplied with a predetermined voltage such as the common voltage $V_{com}$. Alternatively, the storage capacitor $C_{ST}$ includes the pixel electrode 190 and an adjacent gate line called a previous gate line, which overlaps the pixel electrode 190 via an insulator.

For color display, each pixel can represent its own color by providing one of a plurality of red, green and blue color filters 230 in an area corresponding to the pixel electrode 190. The color filter 230 shown in FIG. 2 is provided in the corresponding area of the upper panel 200. Alternatively, the color filters 230 are provided on or under the pixel electrode 190 on the lower panel 100.

A polarizer or polarizers (not shown) are attached to at least one of the panels 100 and 200.

Referring to FIG. 1 again, the gray voltage generator 800 generates two sets of a plurality of gray voltages related to the transmittance of the pixels. The gray voltages in one set have a positive polarity with respect to the common voltage Vcom, while those in the other set have a negative polarity with respect to the common voltage Vcom.

The gate driver 400 is connected to the gate lines $G_1$-$G_n$ of the panel assembly 300 and synthesizes the gate-on voltage $V_{on}$ and the gate off voltage $V_{off}$ from an The data driver 500 is connected to the data lines $D_1$-$D_m$ of the panel assembly 300 and applies data voltages, selected from the gray voltages supplied from the gray voltage generator 800, to the data lines $D_1$-$D_m$.

The signal controller 600 controls the gate driver 400 and the data driver 500 and it includes a frame memory 610 and an image type detector 620 connected to the frame memory 610. The frame memory 610 stores image signals R, G and B for one frame. The image type detector 620 may be a stand-alone device separated from the signal controller 600.

Now, the operation of the LCD will be described in detail.

The signal controller 600 is supplied with input image signals R, G and B and input control signals controlling the display thereof such as a vertical synchronization signal Vsync, a horizontal synchronization signal Hsync, a main clock MCLK, and a data enable signal DE, from an external graphics controller (not shown). After generating gate control signals CONT1 and data control signals CONT2 and processing the image signals R, G and B suitable for the operation of the panel assembly 300 on the basis of the input control signals and the input image signals R, G and B, the signal controller 600 provides the gate control signals CONT1 for the gate driver 400, and the processed image signals R', G' and B' and the data control signals CONT2 for the data driver 500. At this time, the image type detector 620 of the signal controller 600 determines the type of the image, still image or motion image, based on the difference in grays of the image data R, G and B between a previous frame and a present frame. Thereafter, the signal controller 600 modifies the image data in accordance with the image type. This operation of the image type detector 620 will be described later in detail.

The gate control signals CONT1 include a vertical synchronization start signal STV for informing of start of a frame, a gate clock signal CPV for controlling the output time of the gate-on voltage $V_{on}$, and an output enable signal OE for defining the duration of the gate-on voltage $V_{on}$.

The data control signals CONT2 include a horizontal synchronization start signal STH for informing of start of a horizontal period, a load signal LOAD for instructing to apply the data voltages to the data lines $D_1$-$D_m$, a inversion control signal RVS for reversing the polarity of the data voltages (with respect to the common voltage $V_{com}$), and a data clock signal HCLK.

The data driver 500 receives a packet of the image data R', G' and B' for a pixel row from the signal controller 600 and converts the image data R', G' and B' into analog data voltages selected from the gray voltages supplied from the gray voltage generator 800 in response to the data control signals CONT2 from the signal controller 600. Thereafter, the data driver 500 applies the data voltages to the data lines D1-Dm.

Responsive to the gate control signals CONT1 from the signal controller 600, the gate driver 400 applies the gate-on voltage $V_{on}$ to the gate line $G_1$-$G_n$, thereby turning on the switching elements Q connected thereto. The data voltages applied to the data lines D1-Dm are supplied to the pixels through the activated switching elements Q.

The difference between the data voltage and the common voltage $V_{com}$ is represented as a voltage across the LC capacitor $C_{LC}$, i.e., a pixel voltage. The LC molecules in the LC capacitor $C_{LC}$ have orientations depending on the magnitude of the pixel voltage, and the molecular orientations determine the polarization of light passing through the LC layer 3. The polarizer(s) converts the light polarization into the light transmittance.

By repeating this procedure by a unit of the horizontal period (which is indicated by 1H and equal to one period of the horizontal synchronization signal Hsync, the data enable signal DE, and a gate clock signal), all gate lines $G_1$-$G_n$ are sequentially supplied with the gate-on voltage $V_{on}$ during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame are reversed (which is called "line inversion"), or the polarity of the data voltages in one packet are reversed (which is called "dot inversion").

Next, the operation detecting the image type to be displayed, still image or motion image, according to an embodiment of the present invention will be described in detail with reference to FIGS. 3 and 4.

Figure 3:
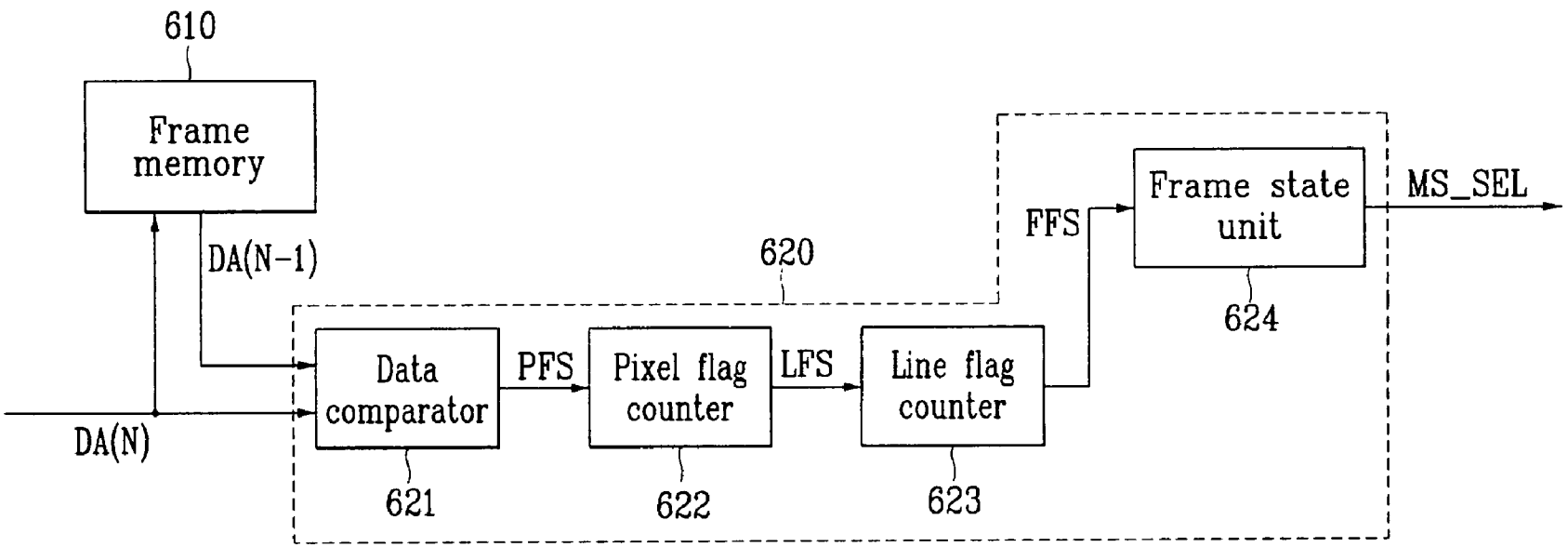
FIG. 3 is a block diagram of an image type detector according to an embodiment of the present invention.

FIG. 3 is a block diagram of an image type detector according to an embodiment of the present invention and FIGS. 4A to 4D are timing diagrams of the image type detector shown in FIG. 3 according to an embodiment of the present invention.

As shown in FIG. 3, the image type detector 620 includes a data comparator 621, a pixel flag counter 622 connected to the data comparator 621, a line flag counter 623 connected to the pixel flag counter 622, and a frame state detector 624 connected to the line flag counter 623.

The data comparator 621 is connected to a frame memory 610 and supplied with image data DA(N) for a present frame (for example, the N-th frame) and image data DA(N−1) for a previous frame (for example, the (N−1)-th frame).

In detail, the image data DA(N) for a frame are sequentially inputted to the frame memory 610 and the image type detector 620, and then they are stored in the frame memory 610. At this time, the image type detector 620 reads out the image data DA(N) for the present frame (referred to as "present data" hereinafter) and the image data DA(N−1) for the previous frame (referred to as "previous data" hereinafter) already stored in the frame memory 610.

The image type detector 620 compares the present data DA(N) with the previous data DA(N−1) and determines whether the image to be displayed is still image or motion image.

Figure 4A:
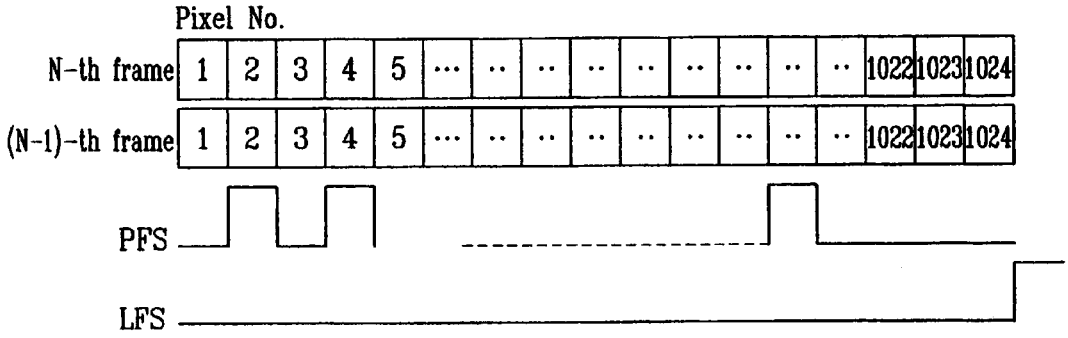
FIGS. 4A to 4D are exemplary timing diagrams of the image type detector shown in FIG. 3.

Referring to FIG. 4A, when the present data DA(N) and the previous data DA(N−1) are applied to the data comparator 621 of the image type detector 620, the data comparator 621 compares the previous data DA(N−1) with the present data DA(N) That is, the data comparator 621 compares gray values of the image data for each pixel between the previous frame and the present frame.

As shown in FIG. 4A, after the data comparator 621 compares the image data DA(N) and DA(N−1) for each pixel row, it generates and provides a pixel flag signal PFS for the pixel flag counter 622. The data comparator 621 generates a pulse in the pixel flag signal PFS whenever the previous data DA(N−1) differs from the present data DA(N) or the difference between the previous data DA(N−1) and the present data DA(N) is larger than a predetermined value.

The pixel flag counter 622 counts the number of pulses in each pixel flag signal PFS and determines whether the data state of the pixel row for the present frame differs from that for the previous frame and it generates a line flag signal LFS based on the determination. For example, when the number of pulses in one pixel flag signal PFS is more than about 30% of the total number of pixels of the corresponding pixel row, that is, the number of pixels having the previous data DA(N−1) different from the present data DA(N) is more than about 30% of the number of the pixel in the row, the pixel flag counter 622 determines that a data state of the row for the present frame differs from that for the previous frame and it generates a pulse in the line flag signal LFS. The duration of the pulse preferably coincides with the duration of the corresponding row data.

For an XGA LCD including 1024 pixels in a row, when the present data DA(N) for about more than 312 pixels differs from the previous data DA(N−1), the pixel flag counter 622 generates a pulse in the line flag signal LFS.

Figure 4B:
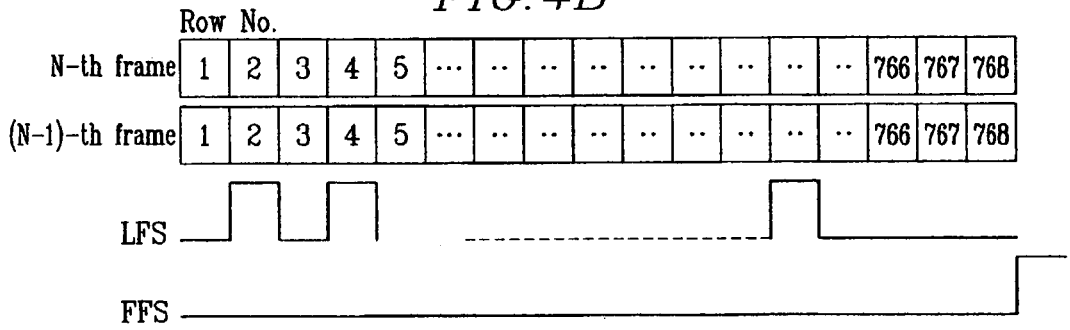

The line flag counter 623 counts the number of pulses contained in the line flag signal LFS supplied from the pixel flag counter 622, determines whether the state of the present frame is different from the state of the previous frame, and generates a frame flag signal FFS to be supplied to the frame state detector 624. As shown in FIG. 4B, when the number of pulses in the line flag signal LFS is more than a predetermined number, for example, when the present data DA(N) for more than about 30% of all rows differ from the previous data DA(N−1), the line flag counter 623 determines that the image data DA(N) for the present frame is different from the image data DA(N−1) for the previous frame. In this case, the image data DA(N) of the present frame are considered to represent a motion image compared with the image data DA(N−1) of the previous frame. Then, the line flag counter 623 generates a pulse. The duration of the pulse preferably coincides with the duration of the corresponding frame data.

For the XGA LCD having 768 pixel rows (or gate lines), when the number of pulses contained in the line flag signal LFS is about 265 (i.e., about 30% of the total number of possible pulses), the line flag counter 623 generates a pulse in the frame flag signal FFS (FIG. 4B).

Figure 4C:
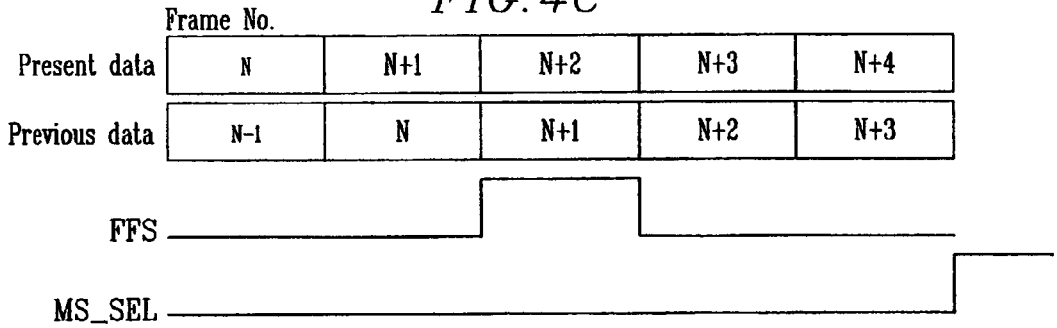

A frame flag signal FFS may be generated five successive frames as shown in FIG. 4C.

Figure 4D:
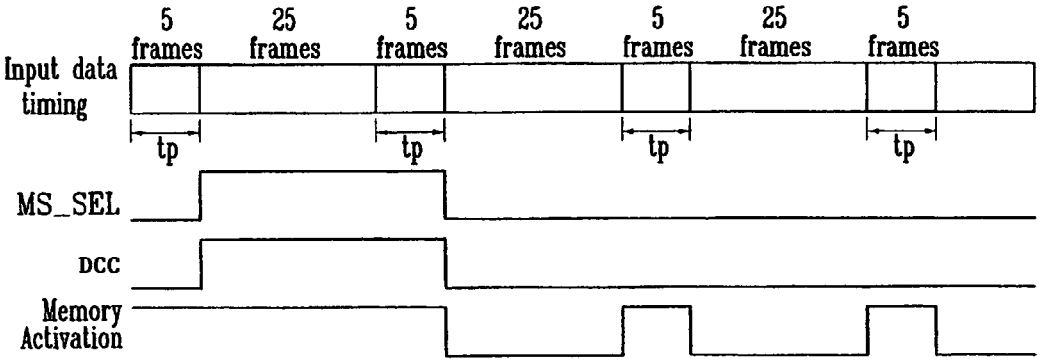

The frame state detector 624 generates an image type detection signal MS_SEL having a state depending on the frame flag signal FFS supplied from the line flag counter 623. For example, when any one of the five consecutive frames (referred to as a "filtering period" hereinafter) differs from the previous frame, that is, when even a pulse is contained in the frame flag signal FFS, the frame state detector 624 changes the state of the image type detection signal MS_SEL from a low level to a high level at the end of the filtering period. The interval between adjacent filtering periods may be 25 frames as shown in FIG. 4D. Then, the signal controller 600 regards the image represented by the image data for 25 frames after the filtering period and for the next filtering period as motion image. Accordingly, the image type detection signal MS_SEL maintains the high level for 30 consecutive frames after the filtering period, i.e., the 25 successive frames after the filtering period and the next filtering period, as shown in FIG. 4D.

When the image type detection signal MS—SEL maintains the low state, the signal controller 600 suspends image data modification such as DCC and also suspends operations of memories such as the frame memory 610 required for the image data modification by blocking off supply voltages, etc. However, the frame memory 610 is activated during the filtering period for data comparison as shown in FIG. 4D.

When the image type detection signal MS_SEL maintains the high level the signal controller 600 normally performs the image data modification, and supplies supply voltages for operation to the memories.

As described above, the signal controller 600 determines whether image for a predefined number of frames is motion image or still image, and, if the image is the still image, the signal controller 600 stops voltage supply to elements that need not be substantially activated, thereby decreasing the power consumption.

For example, the cut off of the supply voltages to the memories may decrease the power consumption to about 5%.

The numerical values in the above-described embodiments of the present invention are chosen by experiments, and they may be changed depending on the circumferential environment.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An apparatus for driving a liquid crystal display including a plurality of pixels arranged in a matrix, the apparatus comprising:

a gray voltage generator generating a plurality of gray voltages;

a data driver selecting data voltages from the gray voltages corresponding to image data and applying the data voltages to the pixels; and a signal controller supplying the image data for the data driver, determining image types of images represented by the image data in two adjacent frames during an interval period based on the difference in the image data between two adjacent frames during a filtering period, and suspending image data modification during a predetermined period if the image types of images during the interval period are determined to be still images, the signal controller comparing a present image data with a previous image data for each pixel and generates a first comparison signal for each pixel row, the signal controller counting the number of the pulses contained in each of the first comparison signals and generates a second comparison signal for each frame, the signal controller counting the number of the pulses contained in each of the second comparison signals and generates a third comparison signal for the filtering period, the signal controller determining that the image types during the interval period following the filtering period are motion images if the respective number of the pulses contained in the third comparison signals for the interval period is more than a third predetermined number and, that if not, the image data for the filtering period are still images, and the signal controller outputting an image type selection signal having a first state or a second state based on the determination.

2. The apparatus of claim 1, wherein the image data modification includes at least one of the image data modifications that include DCC (dynamic capacitance compensation), ACCE (adaptive color contrast enhancement), and ACC (accurate color capture).

3. The apparatus of claim 1, wherein the signal controller determines the image types as motion images when the number of the pixels having different image data between two adjacent frames or the number of the pixels having the difference in the image data between two adjacent frames larger than a predetermined value is more than a predetermined number.

4. The apparatus of claim 1, wherein the signal controller comprises:

a data comparator for comparing the present image data with the previous image data for each pixel and for generating the first comparison signal for each pixel row, the first comparison signal having pulses generated when the present image data differs from the previous image data or when the difference between the present image data and the previous image data is larger than a predetermined value;

a first counter for counting the number of the pulses contained in each of the first comparison signals and for generating the second comparison signal for each frame, the second comparison signal having pulses generated when the number of the counted pulses in the respective first comparison signals is larger than a first predetermined number;

a second counter for counting the number of the pulses contained in each of the second comparison signals and generating the third comparison signal for the filtering period, the third comparison signal having pulses generated when the number of the counted pulses in the respective second comparison signals is larger than a second predetermined number; and a frame state detector for determining that the image types during the interval period following the filtering period are motion images if the respective number of the pulses contained in the third comparison signals for the interval period is more than a the third predetermined number and, that if not, the image data for the filtering period are still images, and for outputting the image type selection signal having the first state or the second state based on the determination.

5. The apparatus of claim 4, wherein the first predetermined number is larger than 30% of the total number of possible pulses in the first comparison signal.

6. The apparatus of claim 4, wherein the second predetermined number is larger than 30% of the total number of possible pulses in the second comparison signal.

7. The apparatus of claim 4, wherein the third predetermined number is equal to or larger than one.

8. The apparatus of claim 4, wherein the interval period includes twenty-five sequential frames.

9. The apparatus of claim 8, wherein the filtering period includes five sequential frames.

10. The apparatus of claim 9, wherein the signal controller determines image types of images represented during a next filtering period that follows the interval period based on the image types of images represented during the interval period.

11. The apparatus of claim 4, wherein the image type selection signal maintains either a first state or a second state during the interval period and the next filtering period, and the first state is one of a high state or a low state.

12. The apparatus of claim 1, wherein the signal controller further comprises a frame memory storing image data for at least one frame.

13. A method for driving a liquid crystal display including a plurality of pixels arranged in a matrix, the method comprising:

reading out image data of a previous frame and of a present frame;

comparing the image data of the previous frame with the image data of the present frame for every pixel;

generating a first comparison signal for each pixel row, the first comparison signal including pulses generated when the image data of the previous frame differs from the image data of the present frame or the difference between the image data of the previous frame and the image data of the present frame is larger than a predetermined value;

counting the number of the pulses included in each of the first comparison signals;

generating a second comparison signal for each frame, the second comparison signal including pulses generated when the number of the counted pulses in the respective first comparison signals is larger than a first predetermined number;

counting the number of the pulses included in each of the second comparison signals;

generating a third comparison signal for each of first periods, the third comparison signal including pulses generated when the number of the counted pulses in the respective second comparison signals is larger than a second predetermined number;

determining that image data for respective second periods following the first periods represent motion image when the respective number of the pulses included in the third comparison signals is larger than a third predetermined number, determining as still image if not; and suspending predetermined control operation if the image data represent still image.

14. The method of claim 13, wherein a first period includes five sequential frames.

15. The method of claim 14, wherein a type of an image for a first period is determined to be the same as the type of the image for a preceding second period.

16. The method of claim 13, wherein a second period includes twenty five sequential frames.

17. The method of claim 16, wherein a type of an image for a first period is determined to be the same as the type of the image for a preceding second period.

18. The apparatus of claim 10, wherein the image types of images represented during the interval period are substantially the same as the image types of images represented during the next filtering period.

19. The apparatus of claim 1, wherein the predetermined period has a combined length of the interval period and the filtering period.

20. An apparatus for driving a liquid crystal display including a plurality of pixels arranged in a matrix, the apparatus comprising:

a gray voltage generator adapted to generate a plurality of gray voltages;

a data driver adapted to select data voltages from the gray voltages corresponding to image data and applying the data voltages to the pixels; and a signal controller adapted to supply the image data for the data driver, wherein the signal controller compares present image data with previous image data for each pixel and generates a first signal for each pixel row, wherein the signal controller counts the number of pulses in each of the first signals and generates a second signal for each frame, wherein the signal controller counts the number of pulses in each of the second signals and generates a third signal, wherein the signal controller determines whether the image types are motion images if the number of the pulses in the third signals is more than a third predetermined number and, if not, the image types are still images, and wherein the signal controller outputs an image type selection signal having a first state or a second state based on the determination.

21. The apparatus of claim 20, wherein the signal controller determines image types of images represented by the image data in two adjacent frames during an interval period based on the difference in the image data between two adjacent frames during a filtering period, and suspends image data modification during a predetermined period if the image types of images during the interval period are determined to be still images.

22. The apparatus of claim 21, wherein the image data modification includes at least one of the image data modifications that include DCC (dynamic capacitance compensation), ACCE (adaptive color contrast enhancement), and ACC (accurate color capture).

23. The apparatus of claim 21, wherein the signal controller determines the image types as motion images when the number of the pixels having different image data between two adjacent frames or the number of the pixels having the difference in the image data between two adjacent frames larger than a predetermined value is more than a predetermined number.

24. The apparatus of claim 21, wherein the interval period includes twenty-five sequential frames.

25. The apparatus of claim 21, wherein the filtering period includes five sequential frames.

26. The apparatus of claim 21, wherein the signal controller determines image types of images represented during a next filtering period that follows the interval period based on the image types of images represented during the interval period.

27. The apparatus of claim 26, wherein the image type selection signal maintains either the first state or the second state during the interval period and the next filtering period, and the first state is one of a high state or a low state.

28. The apparatus of claim 20, wherein the signal controller comprises a data comparator adapted to compare the present image data with the previous image data for each pixel and generate the first signal for each pixel row, wherein the first signal comprises pulses generated when the present image data differs from the previous image data or when the difference between the present image data and the previous image data is larger than a predetermined value.

29. The apparatus of claim 20, wherein the signal controller comprises a first counter adapted to count the number of pulses in each of the first signals and generate the second signal for each frame, wherein the second signal comprises pulses generated when the number of counted pulses in the first signals is larger than a first predetermined number.

30. The apparatus of claim 29, wherein the first predetermined number is larger than 30% of the total number of possible pulses in the first comparison signal.

31. The apparatus of claim 20, wherein the signal controller comprises a second counter adapted to count the number of pulses in each of the second signals and generate the third signal, wherein the third signal comprises pulses generated when the number of counted pulses in the second signals is larger than a second predetermined number.

32. The apparatus of claim 31, wherein the second predetermined number is larger than 30% of the total number of possible pulses in the second comparison signal.

33. The apparatus of claim 20, wherein the signal controller comprises a frame state detector adapted to determine whether the image types are motion images if the number of pulses in the third signals is more than the third predetermined number and, if not, the image types are still images, and output an image type selection signal having a first state or a second state based on the determination.

34. The apparatus of claim 33, wherein the third predetermined number is equal to or larger than one.

35. The apparatus of claim 20, wherein the signal controller comprises a frame memory storing image data for at least one frame.

* * * * *